US008387541B2

(12) United States Patent
Losito

(10) Patent No.: US 8,387,541 B2
(45) Date of Patent: Mar. 5, 2013

(54) PLATFORM GATE FOR TRAIN STATIONS

(75) Inventor: Pietro Losito, Frossasco (IT)

(73) Assignee: O.C.L.A.P. S.R.L., Turin (IT)

( * ) Notice: Subject to any disclaimer, the term of this patent is extended or adjusted under 35 U.S.C. 154(b) by 411 days.

(21) Appl. No.: 12/663,260

(22) PCT Filed: Feb. 6, 2008

(86) PCT No.: PCT/IB2008/050428

§ 371 (c)(1),
(2), (4) Date: Dec. 4, 2009

(87) PCT Pub. No.: WO2008/149246

PCT Pub. Date: Dec. 11, 2008

(65) Prior Publication Data

US 2010/0180790 A1 Jul. 22, 2010

(30) Foreign Application Priority Data

Jun. 6, 2007 (IT) ..... TO2007A0396

(51) Int. Cl.
*B61B 1/00* (2006.01)

(52) U.S. Cl. ..... 104/30; 104/28; 14/71.1

(58) Field of Classification Search ..... 104/27, 104/28, 29, 30

See application file for complete search history.

(56) References Cited

U.S. PATENT DOCUMENTS

| | | | | |
|---|---|---|---|---|
| 1,259,060 | A * | 3/1918 | West | 49/361 |
| 1,442,431 | A * | 1/1923 | Hoffay | 104/30 |
| 3,512,328 | A * | 5/1970 | Eriksson | 52/787.1 |
| 4,059,194 | A * | 11/1977 | Barry | 414/278 |
| 4,082,042 | A * | 4/1978 | Barry | 104/18 |
| 4,922,655 | A * | 5/1990 | Seal | 49/131 |
| 5,176,082 | A * | 1/1993 | Chun et al. | 104/28 |
| 5,253,589 | A * | 10/1993 | Kawanishi et al. | 104/28 |
| 5,295,441 | A * | 3/1994 | Kawanishi et al. | 104/28 |
| 5,373,120 | A * | 12/1994 | Barrett et al. | 187/316 |
| 5,626,078 | A * | 5/1997 | Fuchs | 104/28 |
| 5,845,579 | A * | 12/1998 | Langley et al. | 104/31 |
| 5,936,232 | A * | 8/1999 | Saretzky | 250/221 |
| 6,105,905 | A * | 8/2000 | Spence | 246/127 |
| 6,131,225 | A * | 10/2000 | Puglisi | 14/71.1 |
| 6,227,523 | B1 * | 5/2001 | Haberlen | 256/59 |
| 6,360,668 | B1 * | 3/2002 | Rauch | 104/30 |
| 6,414,454 | B1 * | 7/2002 | Lhotak et al. | 318/266 |
| 6,741,175 | B1 * | 5/2004 | Rauch | 340/541 |
| 7,143,658 | B2 * | 12/2006 | Schubert | 73/862.632 |
| 7,328,662 | B2 * | 2/2008 | Kasai et al. | 105/429 |
| 7,802,521 | B2 * | 9/2010 | Gunes | 104/30 |
| 2002/0003065 | A1 * | 1/2002 | Tonna et al. | 187/324 |
| 2005/0183338 | A1 * | 8/2005 | Kasai et al. | 49/26 |
| 2006/0140718 | A1 * | 6/2006 | Lamore | 404/6 |

(Continued)

FOREIGN PATENT DOCUMENTS

| | | |
|---|---|---|
| DE | 198 03 991 A1 | 8/1999 |
| EP | 0 525 738 A1 | 2/1993 |

(Continued)

*Primary Examiner* — Jason C Smith
(74) *Attorney, Agent, or Firm* — Sughrue Mion, PLLC

(57) ABSTRACT

A platform screen door system (11) for railway stations, comprising: a set of uprights (13) defining a plurality of gates therebetween; a horizontal beam (17) associated with the top of said uprights (13); a set of sliding doors (15) arranged between said uprights (13) so as to close said gates, said sliding doors being horizontally slidable relative to said uprights so as to define a corresponding passageway (P) in said gates.

22 Claims, 10 Drawing Sheets

U.S. PATENT DOCUMENTS

| | | | | |
|---|---|---|---|---|
| 2006/0147261 | A1* | 7/2006 | Wong | 404/6 |
| 2006/0182495 | A1* | 8/2006 | Bergendahl et al. | 404/6 |
| 2006/0191749 | A1* | 8/2006 | Sasaki et al. | 187/391 |
| 2006/0196733 | A1* | 9/2006 | Tonna et al. | 187/315 |
| 2006/0243535 | A1* | 11/2006 | Kinoshita et al. | 187/319 |
| 2006/0255937 | A1* | 11/2006 | Wong | 340/541 |
| 2008/0190031 | A1* | 8/2008 | Winkelmann et al. | 49/427 |
| 2009/0165665 | A1* | 7/2009 | Gunes | 104/30 |
| 2010/0043664 | A1* | 2/2010 | Winkelmann et al. | 104/31 |
| 2010/0180790 | A1* | 7/2010 | Losito | 104/30 |

FOREIGN PATENT DOCUMENTS

| | | | |
|---|---|---|---|
| EP | 1 566 321 | A1 | 8/2005 |
| EP | 1 743 824 | A1 | 1/2007 |
| GB | 2 291 636 | A | 1/1996 |
| JP | 2000-108889 | A | 4/2000 |
| WO | WO 9938747 | A1 * | 8/1999 |
| WO | WO 2005030629 | A1 * | 4/2005 |
| WO | 2006/131018 | A1 | 12/2006 |

* cited by examiner

PLATFORM GATE FOR TRAIN STATIONS

TECHNICAL FIELD

The present invention relates to a platform screen door system for railways stations, in particular metro railway stations.

STATE OF THE ART

In railway field, in particular in the field of metro trains, it is known equipping the station platforms with safety barriers, known as automated platform gates or platform screen door (PSD) systems, arranged close to the track and parallel thereto, in order to allow getting on and off the train coaches only when the trains are in the station. In this way, passenger access to the track is prevented when the train is not present or when such access is not desired, e.g. for safety reasons.

An example of such a screen door system is disclosed in JP 2000108889.

Such screen door systems are becoming more and more widespread because of the ever increasing number of accidents occurring to passengers in conventional railway stations, which often are not equipped with such safety screen door systems.

Two main problems are encountered when developing screen door systems of the above type. A first problem is preventing the screen door system from hindering, or even preventing passenger disembarkation from trains when the train stops at the station before or after the optimum stop line envisaged by the design. A second problem is dispensing, for reasons of cost and in order to avoid disruption to the station service, with modifying existing platforms when it is desired to install safety screen door systems in older stations that are not equipped with such systems.

According to the prior art, the first problem is solved in present screen door systems by providing pivoting doors, which can be manually opened by acting upon safety handles, between the sliding doors providing access to the coach during regular operation. In this way, if the train stops at an incorrect position, that is, before or after the optimum stop line envisaged by the design, train passengers can leave the coach through the emergency pivoting doors.

Such a solution has however the drawback that it demands manual opening of the pivoting doors by the passengers whenever the trains incorrectly stops.

Moreover, such a solution generally requires a complex supporting structure and is not suitable for use with reduced height screens, e.g. about 2 m high, i.e. screens that do not reach the station ceiling.

DESCRIPTION OF THE INVENTION

Thus, it is a first object of the invention to provide a platform screen door system for railway stations that allows access to the coaches even when the train has not stopped at the correct stop line envisaged by the design.

It is a second object of the invention to provide a system of the above kind, which can be readily installed, without structural interventions, in already existing railway stations.

It is a third object of the invention to provide a system of the above kind, which is easy to manufacture and consequently is reliable in operation and duration.

It is a fourth object of the invention to provide a system of the above kind, which can be quickly installed, without causing disruptions to the station service.

It is a further object of the invention to provide a system for checking the train stop position at a station, so as to allow automatic operation of the platform screen door system even if the train has stopped before or after the optimum stop line envisaged by the design, thereby dispensing with the need of an emergency manual opening of the doors by the passengers in case of too a high offset between the train doors and the platform screen doors.

The above and other objects are achieved by an access system for railway station platforms as claimed in the appended claims.

Advantageously, according to the invention, a screen door system is provided in which the gates between the uprights are equipped with sliding doors.

Advantageously, thanks to the solution according to the present invention, access systems for railway station platforms can be built that are suitable for lines in which "mixed" trains run, i.e. trains where the door pitch is different for different trains.

According to the invention it is possible to build screen door systems capable of correctly operating even if the train stops at a station at least about ±1000 mm before or after the optimum stop line.

Thanks also to the system according to the invention for checking the train stop position at a station, the need of an emergency manual opening of the screen doors by the passengers due to too a high offset between the train doors and the platform screen doors is advantageously dispensed with.

A further advantage of the invention is the possibility of building screen door systems with a reduced height, i.e. that do not reach the station ceiling, since they can be secured only to ground and do not require to be retained at their top.

BRIEF DESCRIPTION OF THE FIGURES

Hereinafter, a non-limiting exemplary embodiment of the invention will be described with reference to the accompanying drawings, in which:

Referring to FIGS. 1A to 1D, screen door system ("screen") 11 according to the invention advantageously comprises a plurality of sliding doors that are capable of overlapping at least partly when they slide relative to each other, since they are slidable in at least two substantially parallel, non-coinciding planes.

FIGS. 1A to 1D show the architecture of a screen 11 according to the invention in as many door opening/closing configurations with respect to a railway coach 111 that moves in the direction of arrow F and that has correctly stopped at the station (FIGS. 1A and 1B), or has stopped early (FIG. 1C) or late (FIG. 1D).

Figure 2:
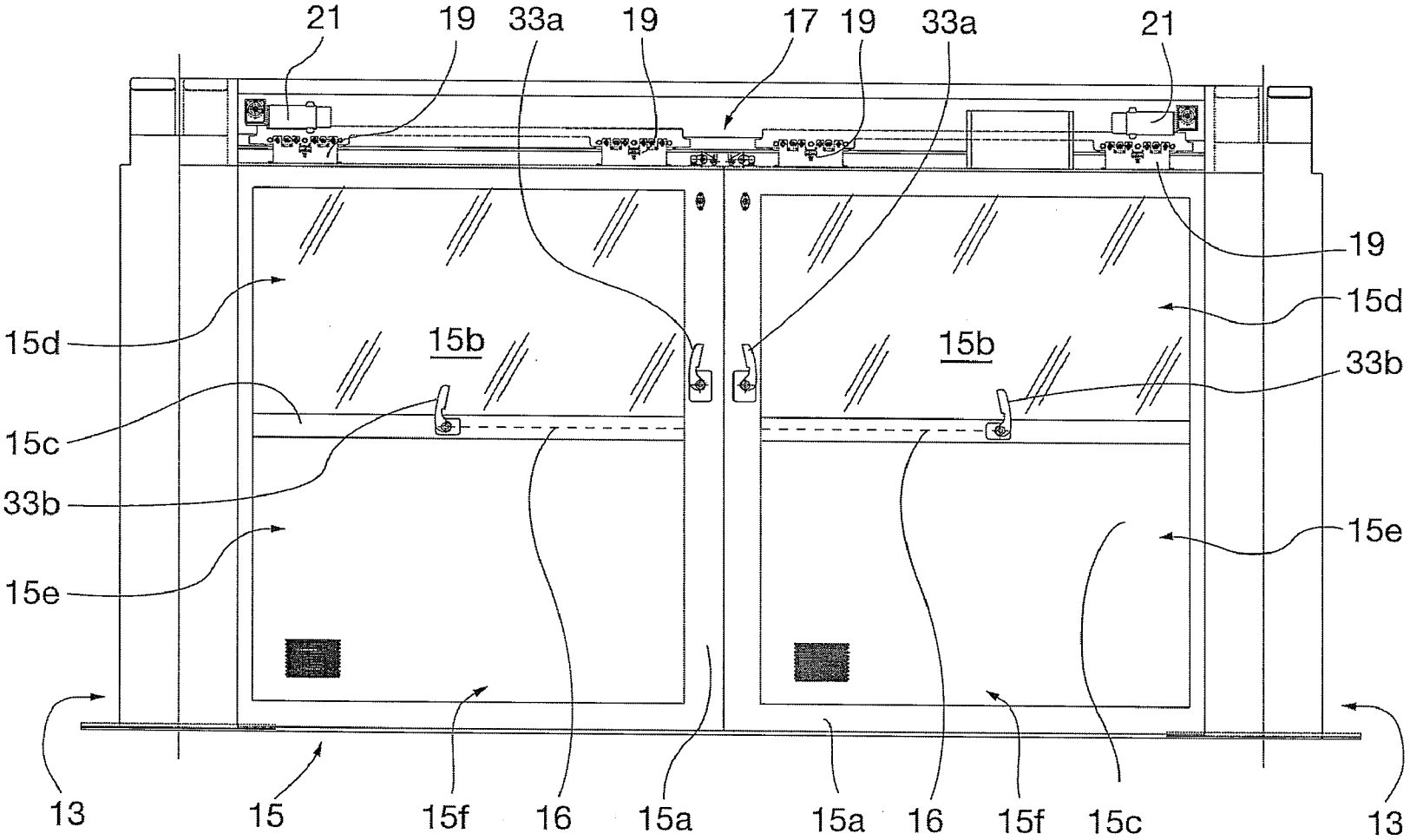
FIG. 2 is a front view, taken from the track side, of a portion of a screen door system according to the invention.
Figure 3B:
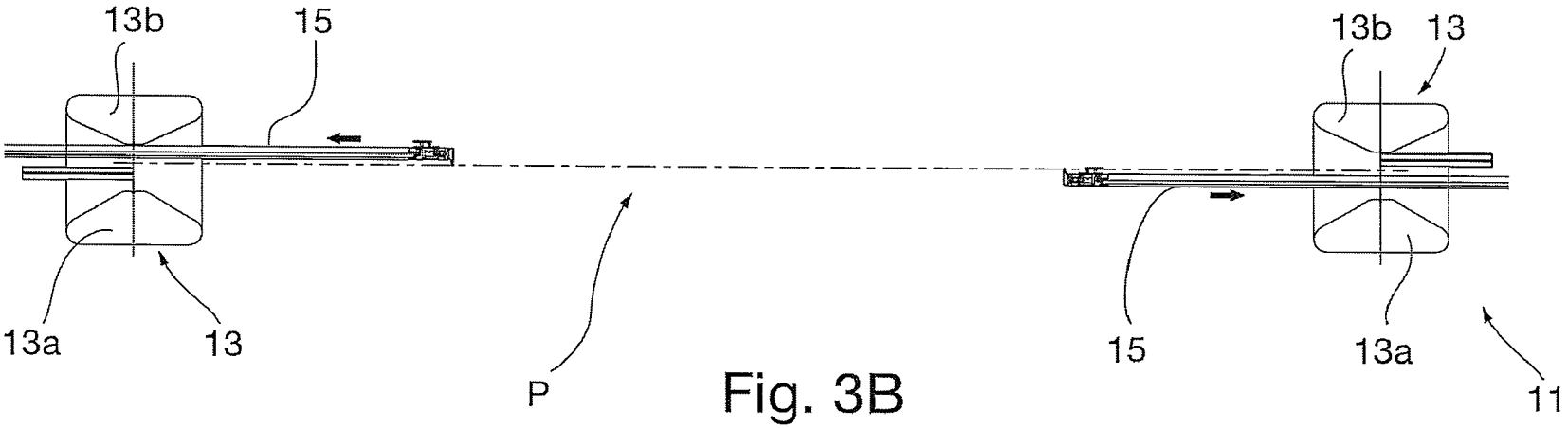
FIGS. 3A and 3B are top views of the portion of a screen door system shown in FIG. 2, with the beam removed, in closed and open position, respectively.
Figure 3A:
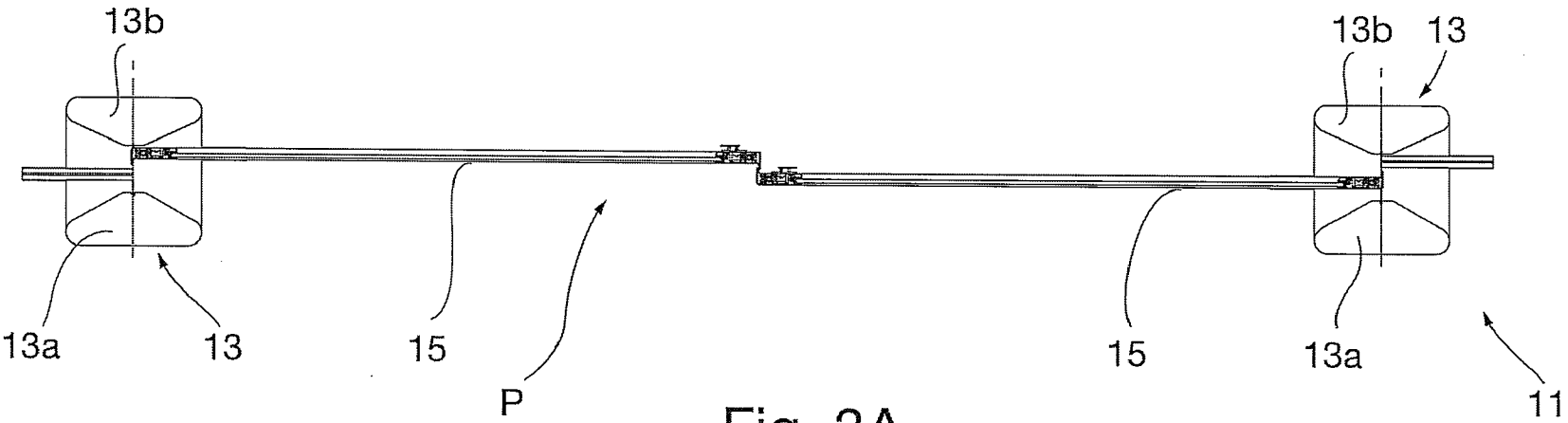
Figure 4:
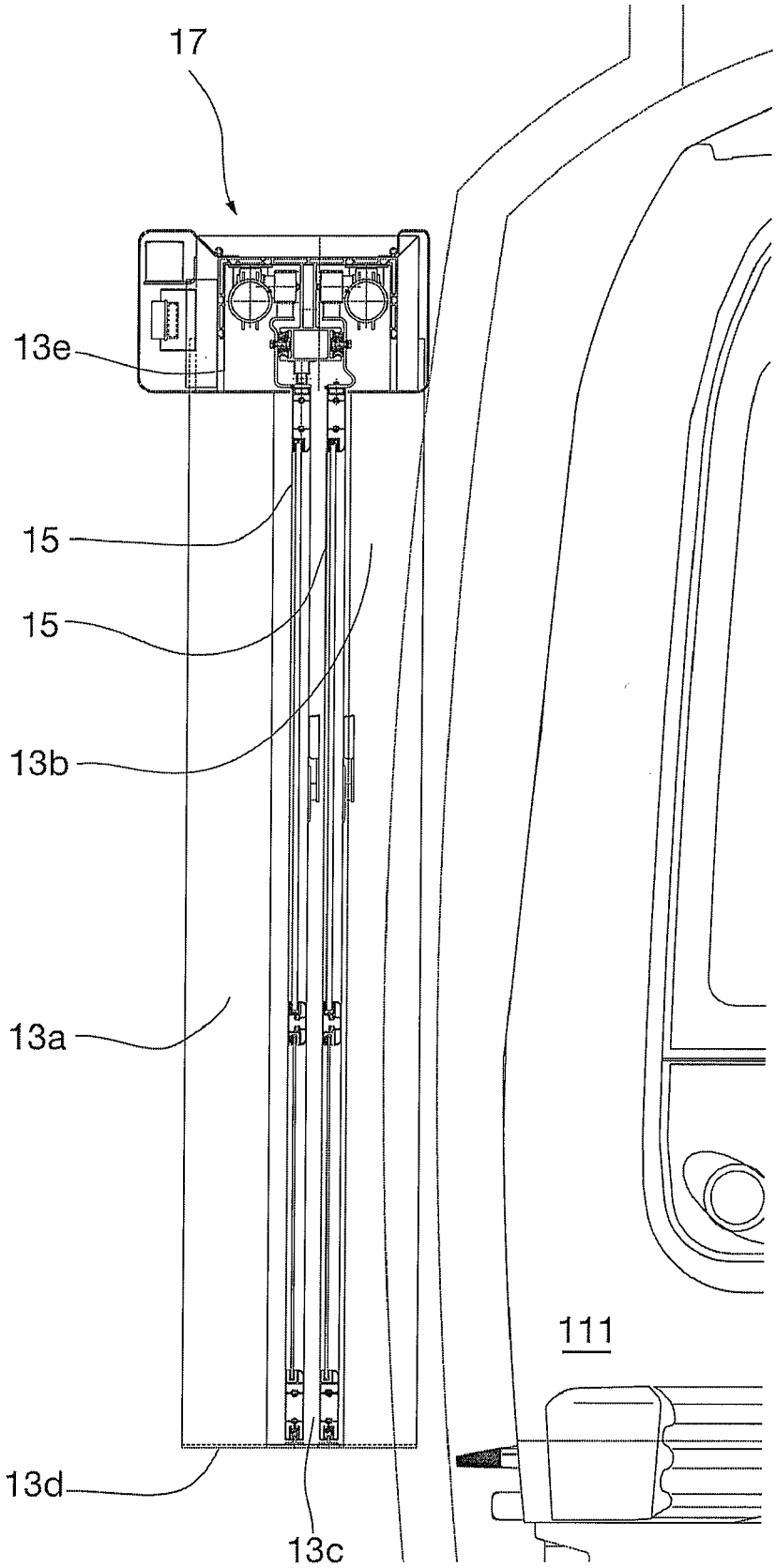
FIG. 4 is a side view, partly in cross section, of an upright.
Figure 5:
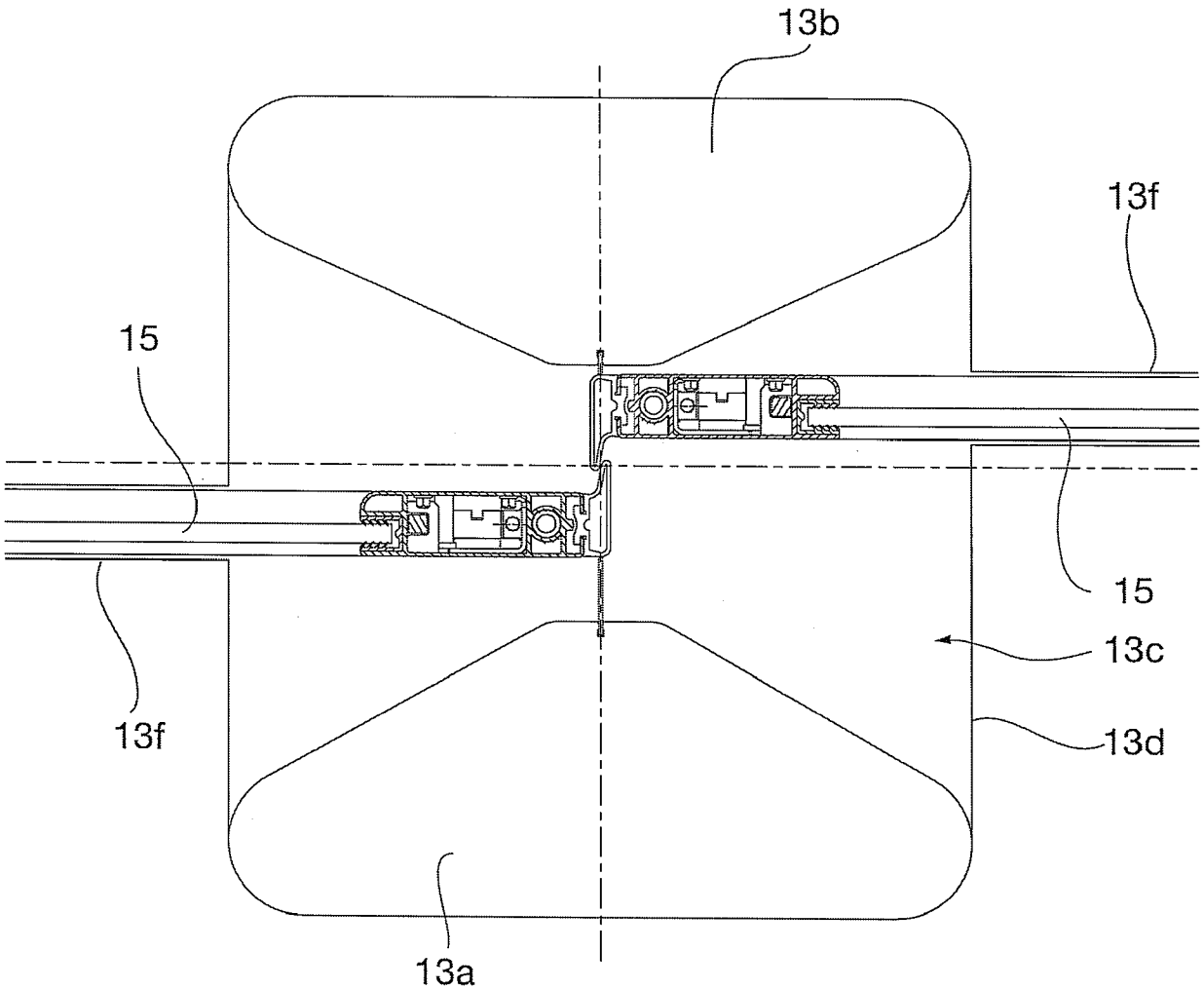
FIG. 5 is a top view of the supporting base of an upright.
Figure 6:
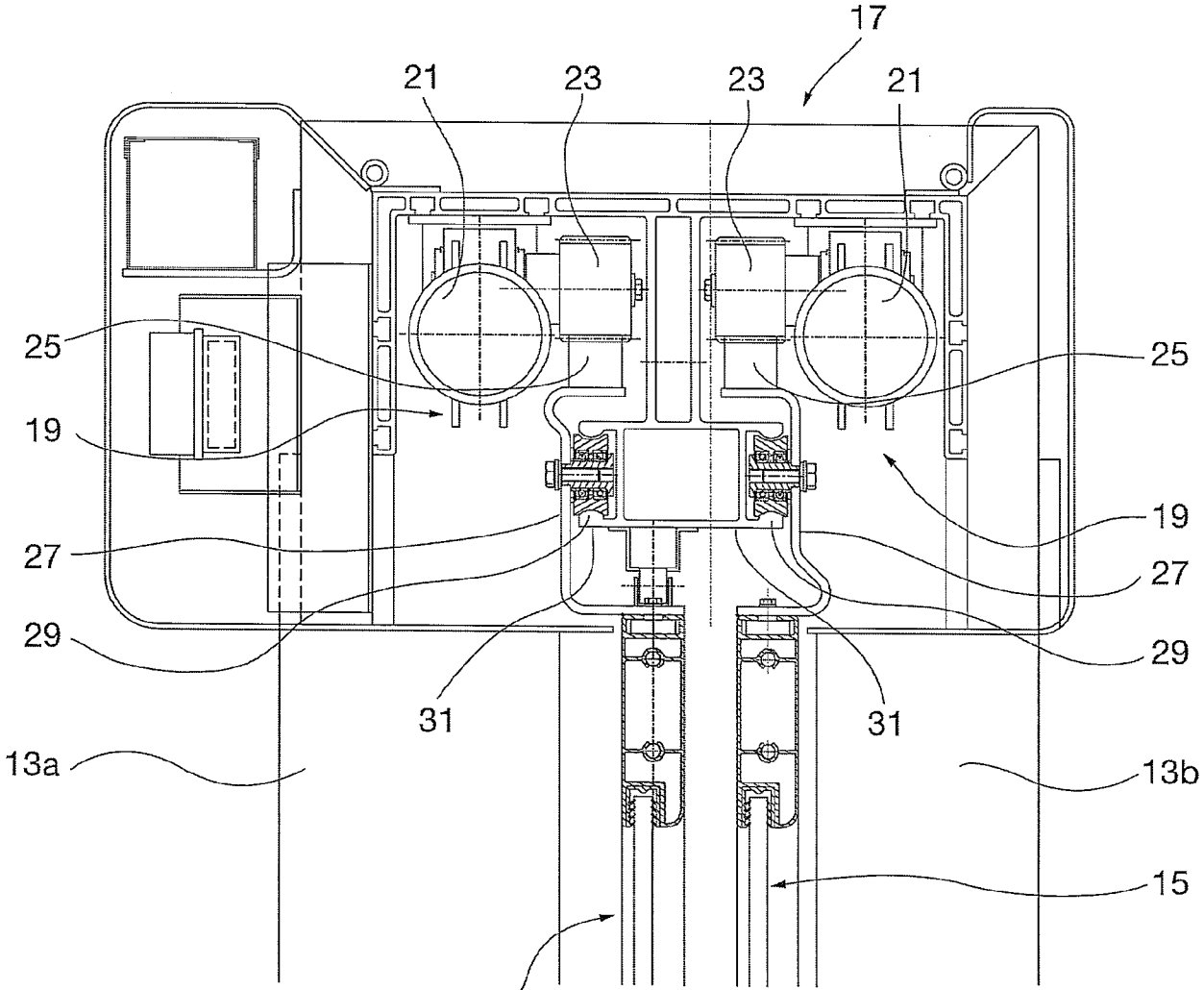
FIG. 6 is a cross-sectional view of the top of an upright.
Figure 7:
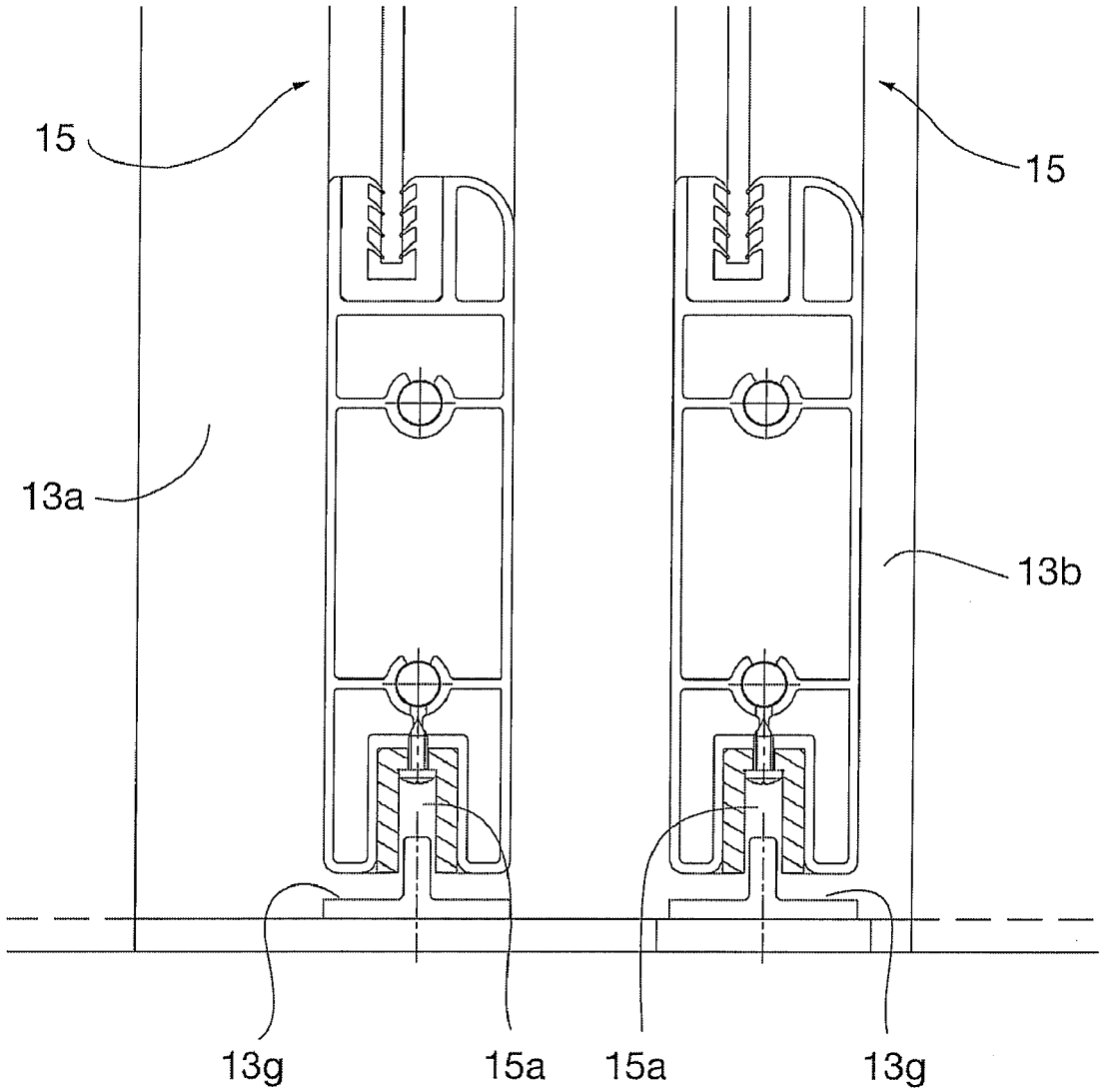
FIG. 7 is a cross-sectional side view of the base of a door pair.

Referring also to FIGS. 2 and 3A and 3B, screen 11 according to a preferred embodiment of the invention substantially consists of a plurality of uprights 13 with which horizontally sliding doors 15 and a beam 17 are associated.

Advantageously, according to the invention, a pair of sliding doors 15 are associated with each upright 13, possibly except the two uprights at the screen ends. The doors are preferably staggered, so that an access passageway P can always be defined between two consecutive uprights 13, by making one door 15 slide to the left and the other to the right relative to the associated upright 13.

To this aim, according to the invention, at least the adjacent doors, occupying adjacent gates between the uprights, are staggered, i.e. they slide in parallel, non-coinciding planes, so that two adjacent doors, occupying adjacent gates between the uprights, can slide relative to each other and at least partly overlap.

Moreover, still according to the invention, doors 15 can advantageously be displaced independently of each other, for instance by providing an independent motorised driving assembly for each door 15. In this manner, thanks to this arrangement, it is advantageously possible to compensate for stopping errors of train 111, by controlling the opening strokes of sliding doors 15 depending on the positions of train doors 113.

Figures 1A, 1B, 1C, 1D:
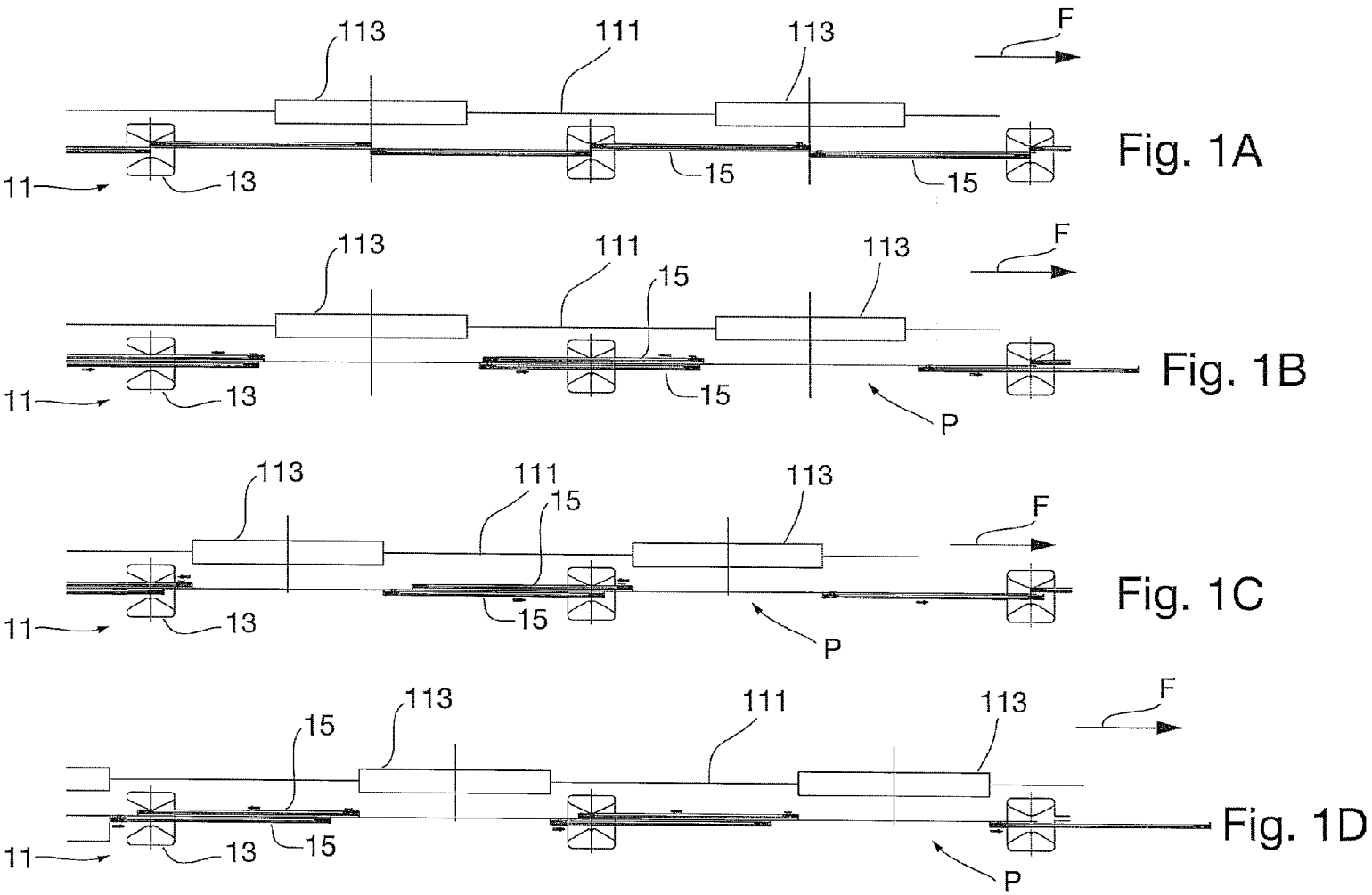
FIGS. 1A to 1D show the screen door system according to the invention in as many opening configurations.

Turning to FIG. 1A, there is shown the closed configuration of doors 15, corresponding to the configuration screen 11 must take when access to the track on which train 111 runs is to be prevented.

Turning to FIG. 1B, there is shown the open configuration of doors 15 when train 111 has correctly stopped at the station, i.e. at the stop line set by design. In this case, doors 15 at the left and the right of each upright are equally displaced so as to define a passageway P for the passengers, substantially at the middle of each gate defined between two uprights 13.

Advantageously, according to the invention, passageway P can be defined, along the gate between two uprights 13, in different positions depending on the position where train 111 stopped, in such a manner that said passageway P can always be lined up with the doors of train 111.

For instance, when train 111 has stopped before said correct stop line, passageway P is defined in a position shifted towards the side of train arrival along the gate between uprights 13. Conversely, when the train has stopped late, passageway P is defined in a position shifted towards the opposite side along the gate between uprights 13. Clearly, the more the train stop position is in advance or is late, respectively, relative to the optimum position, in which train doors 113 are positioned at the centre of the gate defined between two consecutive uprights 13, the greater the shift of passageway P towards the arrival side or the opposite departure side, up to a maximum determined by the maximum stroke of doors 15.

Turning to FIG. 1C, there is shown the opening of doors 15 when train 111 has stopped at the position of maximum tolerable advance relative to said correct stop line. In this case, doors 15 located on the train arrival side relative to each upright 13 (left side of the uprights in FIGS. 1A to 1D) will remain stationary, whereas the right-side doors will be displaced over the whole available stroke thereof thereby engaging the adjacent gate.

The opposite situation is shown in FIG. 1D, which illustrates the opening of doors 15 when train 111 has stopped at the position of maximum tolerable lag relative to said correct stop line. In this case, doors 15 located on the train departure side relative to each upright 13 (right side of the uprights in FIGS. 1A to 1D) will remain stationary, whereas the left-side doors will be displaced over the whole available stroke thereof thereby engaging the adjacent gate.

In conventional manner, the position where train 111 has stopped at the station is signalled by one or more sensors, e.g. optical or magnetic sensors, to a control unit. The signals coming from said sensors allow determining the amount of train offset relative to the optimum stop line and consequently defining passageways P in the screen according to the invention, thanks to the opening of doors 15, in the correct position, exactly in correspondence with train doors 113.

Referring to FIGS. 4 to 7, uprights 13 are preferably formed by a pair of rectilinear members 13*a*, 13*b* arranged parallel to and spaced apart from each other so as to define a gap 13*c* through which a pair of sliding doors 15 pass.

The bottom ends of both rectilinear members 13*a*, 13*b*, which consist e.g. of metal sections, e.g. of steel or aluminium, with trapezoidal cross section, are further associated with a support plate 13*d* defining the supporting base of upright 13. The opposite end of upright 13 is associated with a U-shaped bracket 13*e*, defining the top end portion of upright 13 and keeping members 13*a*, 13*b* spaced apart.

The supporting base of upright 13 defined by plate 13*d* further comprises a pair of opposite rectilinear seats 13*f*, which have associated therewith respective guides 13*g* in the shape of an inverted T, intended to guide in the correct direction, along parallel planes, the sliding of sliding doors 15, which in turn are provided with a slot 15*a* along their bottom edges.

Said guides 13*g* shaped as an inverted T are for instance few centimeters long in order not to be of obstacle to transiting passengers and to limit the available stroke of doors 15.

In the alternative, said T-shaped guides extend over a greater length and can even occupy the whole gap between uprights 13. In that case, they will be preferably associated, on both sides, with an inclined footboard acting as a draft to prevent the guides from being of obstacle to passengers.

Advantageously, supporting base 13*d* can be secured, through screws or bolts or other known means, to the pavement of a railway station platform, even already existing, without need of carrying out modifications and, in particular, without need of lowering the level of the platform pavement.

Beam 17 is associated with the top ends of uprights 13 and it receives pulling mechanisms 19 of the sliding doors, which mechanisms can be made in different manners according to techniques known in the field.

Thanks to the arrangement of pulling mechanisms 19 of sliding doors 15 inside beam 17 positioned on top uprights 13, and consequently above the gates defined between uprights 13, screen 11 according to the invention can be installed on a conventional platform, even of an already existing station, without need of carrying out modifications to the platform, in particular without need of lowering the pavement level, e.g. for housing the door pulling mechanism.

In the illustrated embodiment, pulling mechanisms 19 of sliding doors 15 comprise, for each door 15, an electric motor 21, equipped with an output pinion 23, and a rack 25, which is associated with the upper side of door 15 and with which pinion 23 of motor 21 meshes.

Rotation of pinion 23 imparted by respective motor 21 causes pulling of rack 25 and door 15 associated therewith. Since a motor 21 is provided for each door 15, each door 15 can be displaced independently of the other doors thanks to an electronic control unit, not shown, controlling, based upon signals coming from sensors detecting the train stop position, the opening and closing movement of the doors by suitably energising the electric motors of screen 11.

Sliding doors 15 are further suspended to beam 17 through bogies 27 having wheels 29, which bogies are fastened to the top of doors 15 and roll in respective rails 31 provided in beam 17.

Turning back to FIG. 2, sliding doors 15 comprise a frame 15*a*, e.g. a frame of aluminium, in which a transparent pane 15*b*, preferably of layered glass, is inserted. In the illustrated example, frame 15*a* further comprises at least one transversal transom 15*c* defining a pair of seats, namely a upper seat 15*d* and a lower seat 15*e*, receiving either a pair of layered glazing units or a layered glazing unit 15*b* and a bored metal sheet or a mesh or the like 15*f*, respectively, the latter serving to increase the amount of air circulating between the areas separated by screen 11 when the latter closed.

Doors 15 further comprise an electromagnetically operated locking device in order to lock the doors in closed position, that is, in the position corresponding to the configuration shown in FIG. 1A. Advantageously, the locking device can also be manually operated by means of handles 33*a* in case of emergency. Thanks to handles 33*a*, passengers can release the locking device and moreover manually pull sliding doors 15 in case the automatic system fails to operate.

FIG. 2 also shows optional second handles 33*b*, located approximately at the middle of each door 15 and connected to the control means for the release of the locking device by means of a connecting rod 16. Thanks to said second handles 33*b*, the release of the locking device and the sliding of the doors can advantageously be easily controlled also from a more rearward position.

Thanks to the modular arrangement, it is possible to horizontally enlarge screen 11 according to the invention on an already operating platform in subsequent steps, while never completely stopping the station service.

Figure 8A:
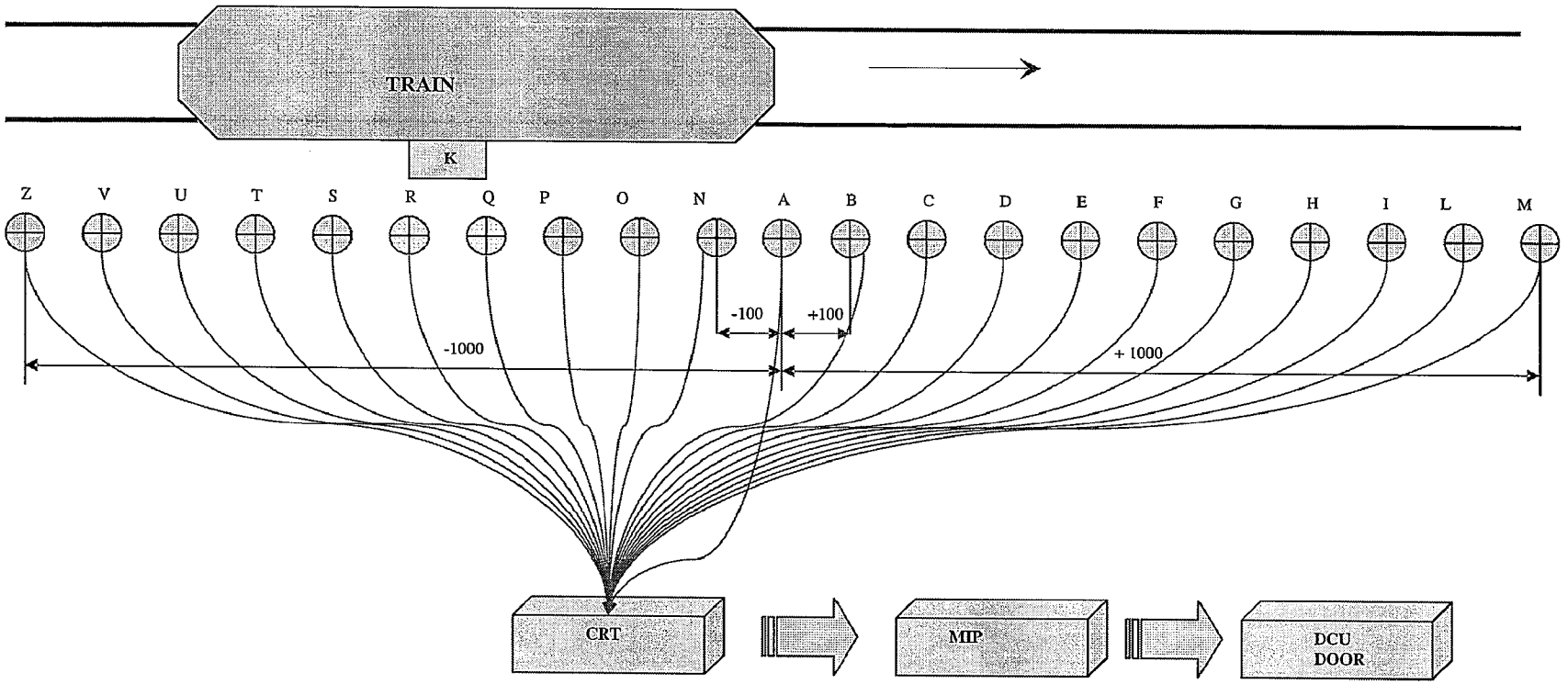
FIGS. 8A to 8C show as many configurations of train stop at a station.
Figure 8B:
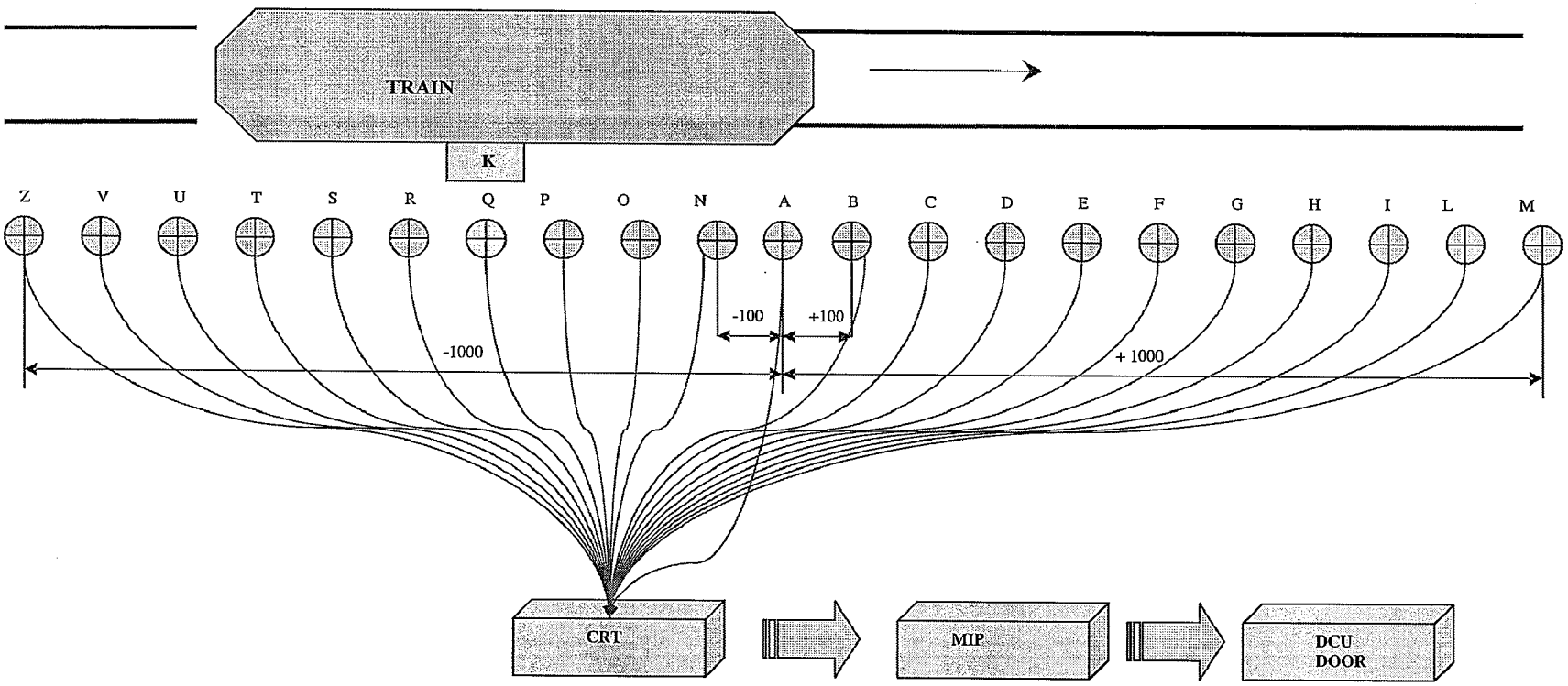
Figure 8C:
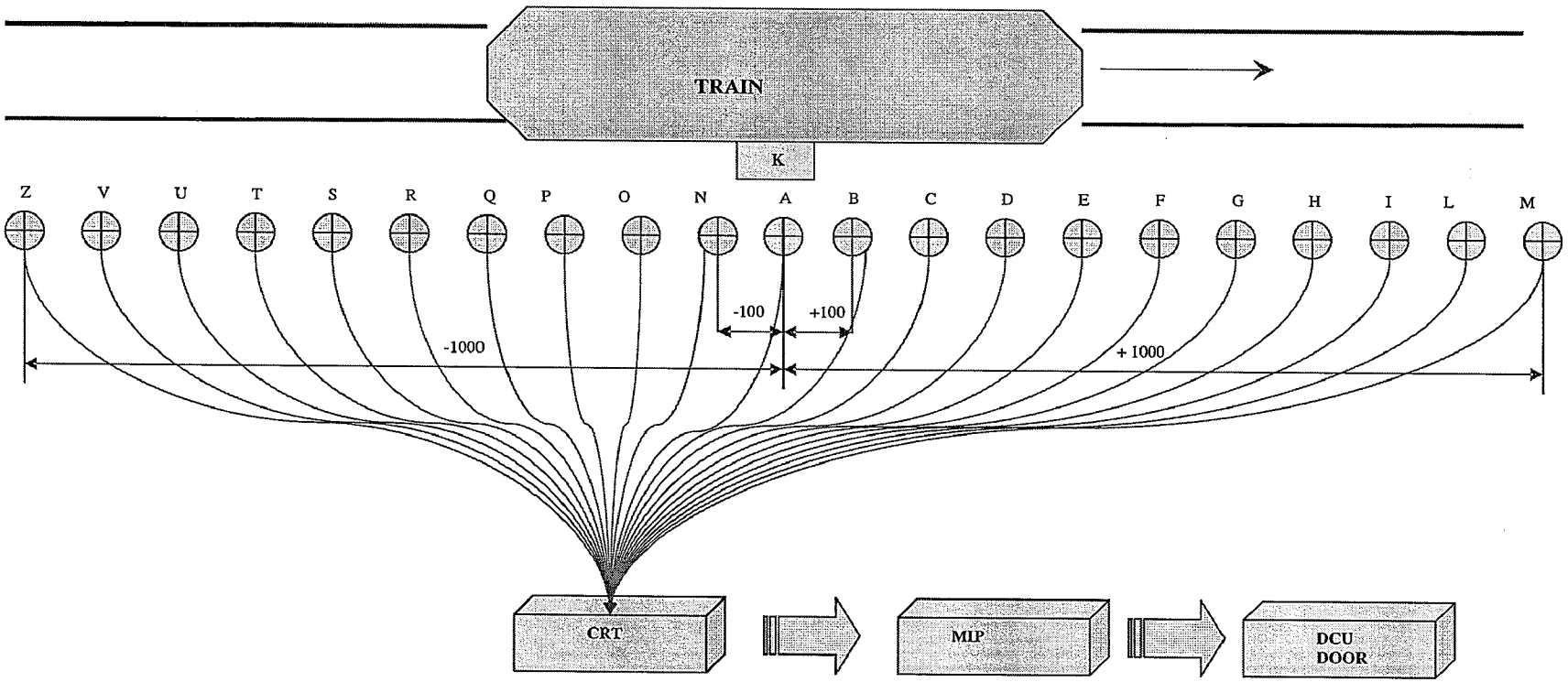

Referring to FIGS. 8A to 8C, there are shown as many configurations of train stop at a station, detected by the train stop detection system according to the invention.

Said system for detecting the train stop position comprises a set of photocells A-Z installed in the station and a light K mounted on the train in such a manner that the photocells are actuated by said light K as the train passes.

Photocells A-Z are moreover associated with a data collection and processing unit CRT, in turn associated with a management interface MIP having a connection gate DCU.

In the illustrated example, the photocells are spaced apart by 100 mm and each said photocell A-Z identifies a specific train stop position relative to a 0 position, corresponding to the optimum stop line, according to the following plan:

A=0 position photocell
B=+100 mm position photocell
C=+200 mm position photocell
D=+300 mm position photocell
E=+400 mm position photocell
F=+500 mm position photocell
G=+600 mm position photocell
H=+700 mm position photocell
I=+800 mm position photocell
L=+900 mm position photocell
M=+1000 mm position photocell
N=−100 mm position photocell
O=−200 mm position photocell
P=−300 mm position photocell
Q=−400 mm position photocell
R=−500 mm position photocell
S=−600 mm position photocell
T=−700 mm position photocell
U=−800 mm position photocell
V=−900 mm position photocell
Z=−1000 mm position photocell Said photocells A-Z can be mounted in a line on a support, which can for instance be associated with the wall of the platform screen centrally thereof or at the end corresponding to the side from which the train leaves the station.

Moreover, the size of light K is chosen so that it simultaneously illuminates two photocells.

According to the invention, when the train enters the station, the stop detection system is activated so that the light located on the train sequentially activates the photocells when intercepting them.

Referring to the diagram of FIG. 8A, the situation is shown in which the train has sequentially passed in front of photocells Z-V-U-T-S (such photocells have been temporarily activated while light K is passing in front of them and have been deactivated when the light is no longer in their operating range) and has stopped with light K in front of photocells R and Q, i.e. it has stopped before optimum stop point 0 corresponding to photocell A.

In such case, since two photocells are concerned, data collection unit CRT processes the train position and indicates that the train has stopped between −400 mm (photocell Q) and −500 mm (photocell R) relative to the zero position corresponding to the optimum stop line, that is the train has stopped at about −450 min.

Referring to the diagram of FIG. 8B, the situation is shown in which the train has stopped with light K in front of photocell Q only.

In such case, since a single photocell is concerned, data collection unit CRT processes the train position and indicates that the train has stopped at −400 mm (photocell Q) relative to the zero position corresponding to the optimum stop line.

Referring to the diagram of FIG. 8C, the situation is shown in which the train has correctly stopped at the station, with light K in front only of photocell A corresponding to the optimum stop line.

In such case, data collection unit CRT processes the train position and indicates that the train has stopped at 0 mm relative to the zero position corresponding to the optimum stop line.

Advantageously, according to the invention, the train stop detection system associated with the platform screen door system enables detecting the correct train stop position and defining corresponding passageways along the screen by suitably controlling the staggered sliding doors.

The invention claimed is:

1. A platform screen door system (11) for railway stations, comprising: a plurality of sliding doors (15), said sliding doors being arranged on substantially parallel planes and being capable of overlapping at least partly when sliding relative to each other in order to define corresponding access passageways, wherein adjacent ones of said sliding doors define respective access gates and wherein said adjacent said sliding doors (15) have a first, closed configuration, in which said gates are closed by the sliding doors (15) and access to a track where trains run is prevented, and a second, open configuration in which one of said access passageways (P) for allowing access to a train is defined in at least one of said gates, wherein said adjacent sliding doors lay mutually staggered on corresponding parallel non coinciding first and second planes in both of said closed and open configurations and while sliding from said closed to said open configuration, said sliding doors comprising a locking device in order to lock the doors in said closed configuration each of said sliding doors being provided with an independent motorised driving assembly thereby permitting to compensate for stopping errors of a train, by controlling the opening strokes of each of said doors in the platform screen door system depending on the positions of train doors, further comprising a set of uprights (13) defining said gates therebetween, respectively; a horizontal beam (17) extending between a top of said uprights (13); wherein said sliding doors (15) arc arranged between said uprights (13) so as to close said gates, said sliding doors being arranged to horizontally slide relative to said uprights so as to define said corresponding passageways (P) in said gates, wherein the uprights (13) are formed by a pair of rectilinear members (13*a*, 13*b*) vertically arranged parallel to and spaced apart from each other so as to define a gap (13*c*) through which said sliding doors (15) pass.

2. The screen door system as claimed in claim 1, wherein two sliding doors (15) are provided between said uprights (13).

3. The screen door system as claimed in claim 1, wherein all of said gates are defined between said uprights (13) provided with said sliding doors (15).

4. The screen door system as claimed in claim 3, wherein said sliding doors, when in said open configuration, at least partly engage with an adjacent one of the gates.

5. The screen door system as claimed in claim 1, wherein bottom ends of the pair of rectilinear members (13*a*, 13*b*) each include a support plate (13*d*) forming a supporting base of the upright (13), and each of the opposite upper ends of the upright (13) includes a U-shaped bracket (13*e*), defining a top end portion of the upright (13).

6. The screen door system as claimed in claim 5, wherein said rectilinear members (13*a*, 13*b*) consist of metal sections of aluminum or steel, having a trapezoidal cross section.

7. The screen door system as claimed in claim 5, wherein said supporting base of the upright (13) defined by said support plate (13*d*) further comprises a pair of opposite rectilinear seats (13*f*) which have respective guides (13*g*) in the shape of an inverted T, to guide sliding movement of the sliding doors (15), and the sliding doors have a slot (15*a*) along bottom edges thereof for receiving a leg of the T-shaped guide.

8. The screen door system as claimed in claim 1, wherein said beam (17) houses a pulling mechanism (19) for pulling the sliding doors.

9. The screen door system as claimed in claim 8, wherein said pulling mechanism (19) comprises an electric motor (21) for each of the sliding doors (15).

10. The screen door system as claimed in claim 9, wherein a rack (25) is provided, for an upper side of each of the sliding doors (15) and with which a pinion (23) for transmission of the motion of said motor (21) meshes.

11. The screen door system as claimed in claim 1, wherein the sliding doors (15) comprise a frame (15*a*) in which a transparent pane (15*b*) is inserted.

12. The screen door system as claimed in claim 11, wherein the frame (15*a*) further comprises a transversal transom (15*c*) defining a pair of seats, including an upper seat (15*d*) and a lower seat (15*e*), receiving either a pair of glazing units or a layered glazing unit (15*b*) and a bored metal sheet or a mesh respectively.

13. The screen door system as claimed in claim 1, wherein a train stop detection system is provided, comprising a set of photocells (A-Z) and a light (K) associated with the train, each of said photocells identifying a specific train stop position relative to a 0 position corresponding to an optimum stop line, and being arranged to be activated by said light (K) as the train passes.

14. The screen door system as claimed in claim 13, wherein said photocells (A-Z) are associated with a data collection and processing unit (CRT).

15. The screen door system as claimed in claim 14, wherein said photocells (A-Z) are mounted in a line on a support on a wall of the platform screen.

16. The screen door system as claimed in claim 15, wherein the light (K) is capable of simultaneously illuminating two said photocells.

17. The screen door system as claimed in claim 13, wherein said photocells (A-Z) are mounted in a line on a support associated with the wall of the platform screen.

18. The screen door system as claimed in claim 17, wherein the light (K) is capable of simultaneously illuminating two said photocells.

19. A method of controlling a platform screen door system (11) for railway stations as claimed in claim 1, comprising the steps of:

determining a position at which a train has stopped relative to an optimum stop line;

independently operating each of said sliding doors so as to define a passageway in correspondence with doors of the coaches of said train.

20. The method as claimed in claim 19, wherein said passageway is defined by displacing the door located on the train arrival side to a greater extent than the door located on the opposite side when the train stop position is before the optimum one.

21. The method as claimed in claim 20, wherein said passageway is defined by displacing the door located on the train departure side to a greater extent than the door located on the arrival side when the train stop position is after the optimum one.

22. The screen door system as claimed in claim 1, wherein the sliding doors (15) are suspended from the beam (17) through bogies (27) having wheels (29), said bogies fastened to a top of the sliding doors (15) and said bogies roll in respective rails (31) provided in the beam (17).

* * * * *